US008931414B1

(12) United States Patent
Boswell et al.

(10) Patent No.: US 8,931,414 B1
(45) Date of Patent: Jan. 13, 2015

(54) REACTION CONTAINER CONTAINING ALUMINUM

(71) Applicants: Christopher Boswell, Hayattesville, MD (US); Carl Gotzmer, Accokeek, MD (US); Steven Kim, Crofton, MD (US); Steve Dunham, Alexandria, VA (US); Michael Dunn, La Plata, MD (US)

(72) Inventors: Christopher Boswell, Hayattesville, MD (US); Carl Gotzmer, Accokeek, MD (US); Steven Kim, Crofton, MD (US); Steve Dunham, Alexandria, VA (US); Michael Dunn, La Plata, MD (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 13/815,380

(22) Filed: Feb. 27, 2013

(51) Int. Cl.

| | |
|---|---|
| ***F42B 3/04*** | (2006.01) |
| ***F42B 12/00*** | (2006.01) |
| ***F42B 22/00*** | (2006.01) |
| ***F42B 12/02*** | (2006.01) |
| *F42B 12/36* | (2006.01) |
| *F42B 12/20* | (2006.01) |

(52) U.S. Cl.
CPC . *F42B 3/04* (2013.01); *F42B 12/02* (2013.01); *F42B 12/36* (2013.01); *F42B 22/00* (2013.01); *F42B 12/20* (2013.01)
USPC ..... 102/315; 102/331; 102/332; 102/406; 102/416

(58) Field of Classification Search
CPC ..... F42B 1/00; F42B 3/00; F42B 3/04; F42B 12/00; F42B 12/02; F42B 12/20; F42B 12/201; F42B 12/207; F42B 12/208; F42B 12/36; F42B 12/44; F42B 12/46; F42B 12/50; F42C 3/00; F42C 19/0846; C06D 5/00; C06D 5/10; C06B 33/00; C06B 43/00; C06B 45/00; C06B 47/00; C06B 47/14
USPC ..... 102/314, 318, 325, 326, 327, 331, 332, 102/364, 399, 403, 424, 315, 406, 408, 416
See application file for complete search history.

(56) References Cited

U.S. PATENT DOCUMENTS

| | | | | |
|---|---|---|---|---|
| 2,509,710 | A * | 5/1950 | Van Loenen | 102/365 |
| 3,109,373 | A | 11/1963 | Saffer, Jr. | |
| 3,111,439 | A | 11/1963 | Brunauer | |
| 3,358,600 | A * | 12/1967 | Griffith et al. | 102/318 |
| 4,160,413 | A | 7/1979 | Ridgeway | |
| 4,188,884 | A | 2/1980 | White et al. | |
| 4,280,409 | A | 7/1981 | Rozner et al. | |
| H464 | H * | 5/1988 | Lee et al. | 102/364 |

(Continued)

OTHER PUBLICATIONS

U.S. Statutory Invention Registration, H464, Lee et al ; May 3, 1988.

(Continued)

*Primary Examiner* — James S Bergin
(74) *Attorney, Agent, or Firm* — Fredric J. Zimmerman

(57) ABSTRACT

A reaction container has contains an amount of a water reactive material and a volume of water within the confined space of its interior. The water reactive material, which contains aluminum, is formed as two separate and spaced apart portions. The water is located between the two portions of the water reactive material. A detonation mechanism, which is configured to mix the amount of water reactive material and the volume of water, is provided in communication with each portion of the water reactive material. The volume of water and the aluminum in the water reactive material are stoichiometrically balanced.

18 Claims, 3 Drawing Sheets

(56) References Cited

U.S. PATENT DOCUMENTS

| | | | | |
|---|---|---|---|---|
| 4,950,460 | A * | 8/1990 | Goodwin et al. | 422/239 |
| 5,078,069 | A | 1/1992 | August et al. | |
| 5,212,343 | A | 5/1993 | Brupbacher et al. | |
| 6,736,069 | B2 * | 5/2004 | Kim | 102/301 |
| 7,192,649 | B1 | 3/2007 | Jouet et al. | |
| 7,632,364 | B1 | 12/2009 | Jouet et al. | |
| 8,250,981 | B1 * | 8/2012 | Gotzmer et al. | 102/314 |
| 8,387,535 | B1 * | 3/2013 | Guirguis et al. | 102/315 |

OTHER PUBLICATIONS

J. Katz et al, Metastable Nanosized Aluminum Powder as a Reactant in Energetic Formulations:, Rpt from US Govt Sponsored Research, ca, 1998.

* cited by examiner

REACTION CONTAINER CONTAINING ALUMINUM

STATEMENT OF GOVERNMENT INTEREST

The invention described herein may be manufactured and used by or for the Government of the United States of America for Governmental purposes without the payment of any royalties thereon or therefor.

BACKGROUND OF INVENTION

1) Field of the Invention

The present invention is directed to water reactive materials.

2) Description of Prior Art

The use of reactive powders and in particular powders that react with water are known. This includes the use of such water reactive powders in underwater applications. For example, torpedo warheads utilize powdered forms of low atomic metals, for example, lithium, in order to produce the desired underwater explosion.

Reactions that occur underwater or utilize water as an oxidizing agent, however, are often slowed by the presence of excess amounts water, which cool the desired explosive reaction. Slowing of the reaction decreases the effectiveness of the reaction. Another limitation on the effectiveness of these water reactions results from the premature oxidation of the reactive particles within the reactive material. The size of the particles in the water reactive material also affects the efficiency of the reaction. Using large particles of a water reactive material is inefficient. Smaller particles contact the water with a greater surface area and thereby accelerate the reaction. Reaction time is also limited by diffusion rate. For example, a thick layer of a water reactive material inhibits the reaction by causing a slow diffusion rate.

In general, enhanced shock performance of explosions using water reactive materials comes from increasing the early time frame rate of bubble expansion and sustaining this rate as long as possible. The chemical energy of an underwater explosive is distributed into shock and bubble performance as well as waste energy. Each of the constituents in an underwater explosive contributes to the observed performance. A shock wave initiates the Helium decomposition causing a release of gases and energy, which initiates the chemical decomposition of the oxidizer into gas that drives the early bubble expansion. By increasing the energy release from intimate fuel-oxidizer combinations, i.e., water (oxidizer) and a water reactive material (fuel), in this time frame, an increase in the rate of oxidizer decomposition and, therefore, the shock bubble performance is realized.

Subsequently, the energy released from the fuel reacting with the product gases is generally slow and contributes to the bubble performance. If the expanding mixture is heavy in solids, the conversion of the chemical energy to potential energy will be inefficient and lead to waste energy in the form of hot gases at the end of the bubble expansion. If the expanding mixture is mostly gases, then the peak pressure will be high, but shock wave will only be supported for a short time. Furthermore, the energy from gas producing reactions is generally less than from fuel-oxidizer reactions. However, the conversion of chemical energy to potential energy of the bubble is generally very efficient, leaving no waste energy in the form of hot gases at the end of the bubble expansion. Therefore, a system is needed that optimizes the particle composition and ignition of the water reactive material and improve the mixing of the water reactive material with water in order to improve the resulting explosion.

SUMMARY OF THE INVENTION

Exemplary embodiments of systems and methods in accordance with the present invention provide for the rapid mixing of a water reactive material with water as an oxidizer within a confined reaction container in order to yield an improved bubble expansion and explosion. In one exemplary embodiment, the present invention is directed to a reaction container having an interior and an amount of water reactive material disposed within the interior. The water reactive material is formed as a plurality of separate and spaced apart portions, for example two opposing portions. In one exemplary embodiment, each portion of the water reactive material contains a plurality of distinct particles of the water reactive material, which can be an organic or inorganic water reactive material. Each particle has an average diameter of about 5 nanometers to about 3 micrometers.

Suitable water reactive materials react violently with water to produce gas and heat. In one exemplary embodiment, the water reactive material contains a metal, a metalloid, a metal oxide, a metalloid oxide or combinations thereof. In one exemplary embodiment, the particles are inorganic particles that include magnesium, aluminum, boron, titanium, tungsten, hafnium or combinations thereof. In another embodiment, the inorganic particles include a metal oxide comprising aluminum oxide, titanium oxide, molybdenum oxide, vanadium oxide, iron oxide or combinations thereof. In an exemplary embodiment, the water reactive material contains a plurality of distinct particles of aluminum, and each aluminum particle has a diameter of about 5 nanometers to about 3 micrometers.

The reaction container also includes a predetermined volume of water disposed within the interior. This volume of water is separated from the water reactive material to avoid undesired mixing between the water and the water reactive material. The volume of water is arranged such that the water is located between any two portions of the water reactive material. The amount of water reactive material and the volume of water are stoichiometrically balanced. A detonation mechanism configured to mix the amount of water reactive material and the volume of water is provided in the interior of the reaction container. The detonation mechanism is in communication with at least one of the plurality of portions of water reactive material or the volume of water.

In one exemplary embodiment, the interior of the reaction container includes a first end and a second end opposite the first end. The portions of the water reactive material include a first portion disposed adjacent the first end of the interior and a second portion disposed adjacent the second end. The volume of water is disposed between the first portion and the second portion, i.e., generally in the center of the interior of the container. In this embodiment, the detonation mechanism includes two identical detonation mechanisms that include a first detonation mechanism disposed between the first portion and the first end and a second detonation mechanism disposed between the second portion and the second end.

The present invention is also directed to a reaction container having an interior, an amount of an aluminum containing water reactive material within the interior that is arranged as a plurality of separate and spaced apart portions, a volume of water disposed within the interior, separated from the water reactive material and arranged such that the water is located between any two portions of the water reactive material and a detonation mechanism configured to mix the amount of water reactive material and the volume of water. The water reactive material reacts violently with water to produce gas and heat, and the detonation mechanism is in communication with at least one of the plurality of portions of water reactive material. In addition, the volume of water and the aluminum in the water reactive material are stoichiometrically balanced. In one embodiment, the water reactive material contains about 85% aluminum and about 15% of a plastic binder.

In one embodiment, the water reactive material is configured as two portions. The interior includes a first end and a second end opposite the first end, and the two portions of the water reactive material include a first portion disposed adjacent the first end of the interior and a second portion disposed adjacent the second end. The volume of water is disposed between the first portion and the second portion. The detonation mechanism includes two identical detonation mechanisms having a first detonation mechanism disposed between the first portion and the first end and a second detonation mechanism disposed between the second portion and the second end.

In one exemplary embodiment, the water reactive material includes exploded aluminum, aluminum as a fine powder or combinations thereof. In one exemplary embodiment, each portion of the water reactive material contains a plurality of distinct particles containing the aluminum. Each particle has a diameter of about 5 nanometers to about 3 micrometers.

DETAILED DESCRIPTION OF THE INVENTION

Figure 1:
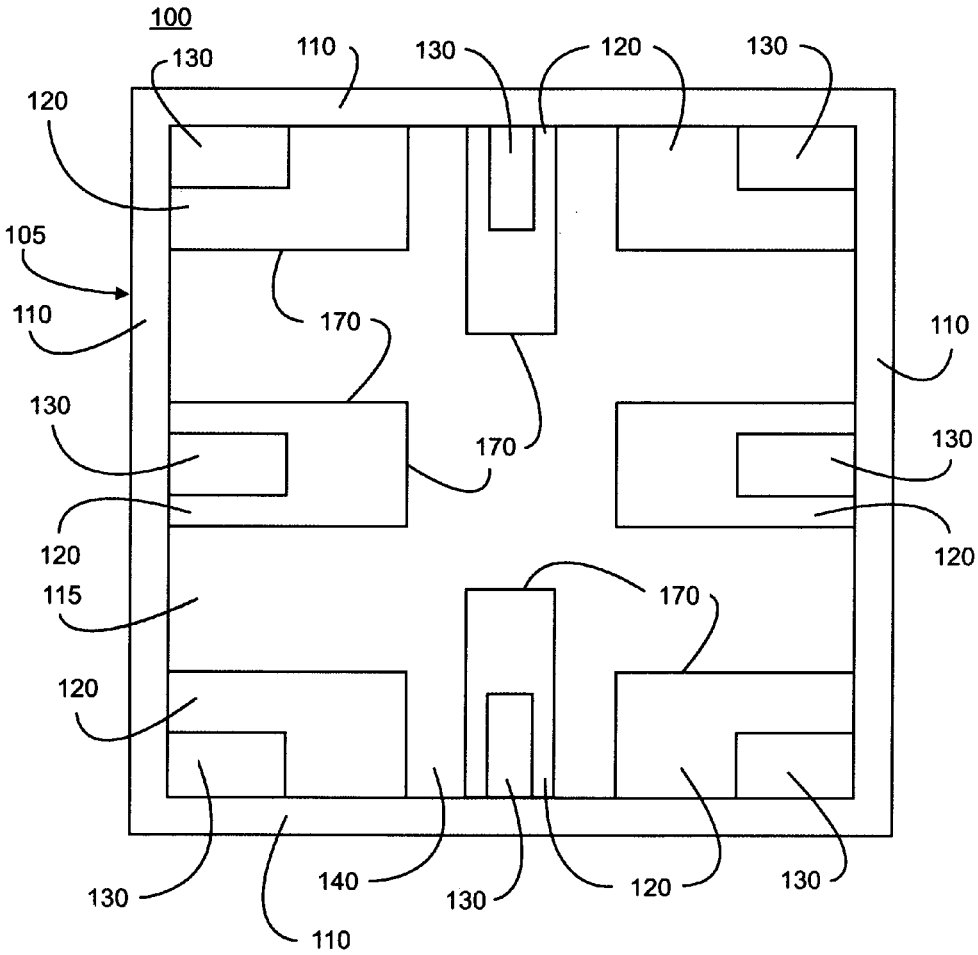
FIG. 1 is a schematic representation of an embodiment of a reaction container in accordance with the present invention.

Exemplary embodiments in accordance with the present invention are directed to methods and systems for reacting a water reactive material with water within the interior of a reaction container. Referring initially to FIG. 1, an embodiment of the reaction container 100 in accordance with an embodiment of the present invention is illustrated. The reaction container includes a container 105 formed from at least one and, in an exemplary embodiment, a plurality of walls 110. The container may have a rectangular, circular, oblong or egg-shaped cross section. In one exemplary embodiment, the container is cylindrical. In another exemplary embodiment, the container is shaped as a spheroid or an oblate spheroid. Therefore, the walls and interior surfaces of the container may be smooth without any sharp corners, enhancing mixing of reaction components within the container.

The container is, in an exemplary embodiment, water-tight and gas-tight. In addition, the walls of the container are constructed of materials and have thicknesses suitable for holding un-reacted components within the container prior to mixing while allowing the expansion of reaction products, e.g., gases, through the walls upon mixing and reaction of the reaction components. Suitable materials for the walls of the container include, but are not limited to, metals, metal alloys, plastics, polymers and combinations thereof.

The walls 110 of the container define an interior 115. The reaction container 100 includes a predefined amount of a water reactive material arranged as a plurality of separate and spaced apart portions 120 of the water reactive material located within the interior 115 of the container 105. The water reactive material utilizes water as an oxidizer and reacts violently with water to produce gas and heat.

Suitable water reactive materials include organic materials, inorganic materials and mixtures thereof. In one embodiment, the water reactive material includes a metalloid, a metal oxide, a metalloid oxide and combinations thereof. For example, the water reactive material can include magnesium, aluminum, titanium, tungsten, hafnium, boron, aluminum oxide, titanium oxide, molybdenum oxide, vanadium oxide, iron oxide and combinations thereof are used. In an exemplary embodiment, the water reactive material includes aluminum, for example bare aluminum. Suitable forms of aluminum include, but are not limited to, exploded aluminum (Alex) and powdered aluminum.

In general, when the water reactive material includes inorganic materials or metals, these materials are included as particles that may be of any suitable shaped but, in an exemplary embodiment, are spherical or oval. In one exemplary embodiment, these inorganic particles have a diameter from about 5 nanometers to about 3 microns. In an exemplary embodiment, the inorganic particles have a diameter from about 50 nanometers to about 100 nanometers. In one exemplary embodiment, the inorganic particles have a diameter of less than about 50 nanometers. Regarding the size of the particles in the water reactive material, smaller particles have a larger surface area per unit weight. Smaller particle sizes increase the surface area of the inorganic particles in contact with the oxidizing agent, i.e., water, causing the reaction to proceed more rapidly.

In one exemplary embodiment, the water reactive material includes bare aluminum. Bare aluminum is formed under an inert atmosphere, for example neon, helium, argon or a similar gas. In this inert atmosphere, bare aluminum is produced by decomposing alane-adducts in organic solvents. A titanium catalyst, i.e., a halide, amide, alkoxide, or other titanium compound, and a catalyst of zirconium, hafnium, vanadium, niobium or tantalum are added. Varying the type and concentration of the catalyst and the type and concentration of the adducting species produces different sizes of bare aluminum particles. Changes to particle size are also achieved through changes in the reaction temperature.

In one exemplary embodiment, the water reactive material contains pellets of a water activated reactive powder (WARP-1) and aluminum. The water reactive material also includes a plastic binder. Suitable plastic binders include, but are not limited to, Poly(methyl methacrylate) (PMMA). The pellets of the WARP-1 and aluminum are pressed together with the plastic binder in order to form the water reactive material. In one exemplary embodiment, the water reactive material includes about 85% aluminum and about 15% plastic binder.

The reaction container also includes a predetermined volume of water 140 also disposed within the interior 115 of the container. The arrangement of the portions of the water reactive material and the volume of water is configured such that water is located between any two portions of the water reactive material. Although illustrated as a single continuous volume, the volume of water also may be configured as a plurality of separate and independent portions. While being located adjacent the water reactive material and disposed between opposing portions of the water reactive material, the volume 140 of water is initially separated from the portions of the water reactive material 120 to prevent an untimely or uncontrolled mixing and reaction between the water and the water reactive material. In one exemplary embodiment, the desired initial separation is achieved by providing a barrier at the location of any interface 170 between the water and the water reactive material. Suitable barriers include physical barriers that are made of a frangible material. The barrier is formed as a layer between the water reactive material and the water. Other suitable barrier layers may be chemically bonded to the water reactive material, for example, on the particle or molecular level.

The reaction container includes one or more detonation mechanisms 130 in communication with one or more of the portions of the water reactive material or the volume of water. In an exemplary embodiment, the detonation mechanism is in communication with the water reactive material. For example, one detonation mechanism is provided in communication with each portion of the water reactive material. Suitable detonation mechanisms are capable of detonating the water reactive material to drive the water reactive material into the water, mixing the water reactive material with the water and producing the desired explosion from the reactive container. In addition, the detonation mechanism is sufficient to overcome the separation barrier provided at the interface between the water reactive material and the water. Suitable detonation mechanisms are known and available in the art and include, for example, polymer bonded explosives (PBX). In one exemplary embodiment, the detonation mechanism contains a $MoSi_2$ reactive material pellet and a hot wire.

Figure 2:
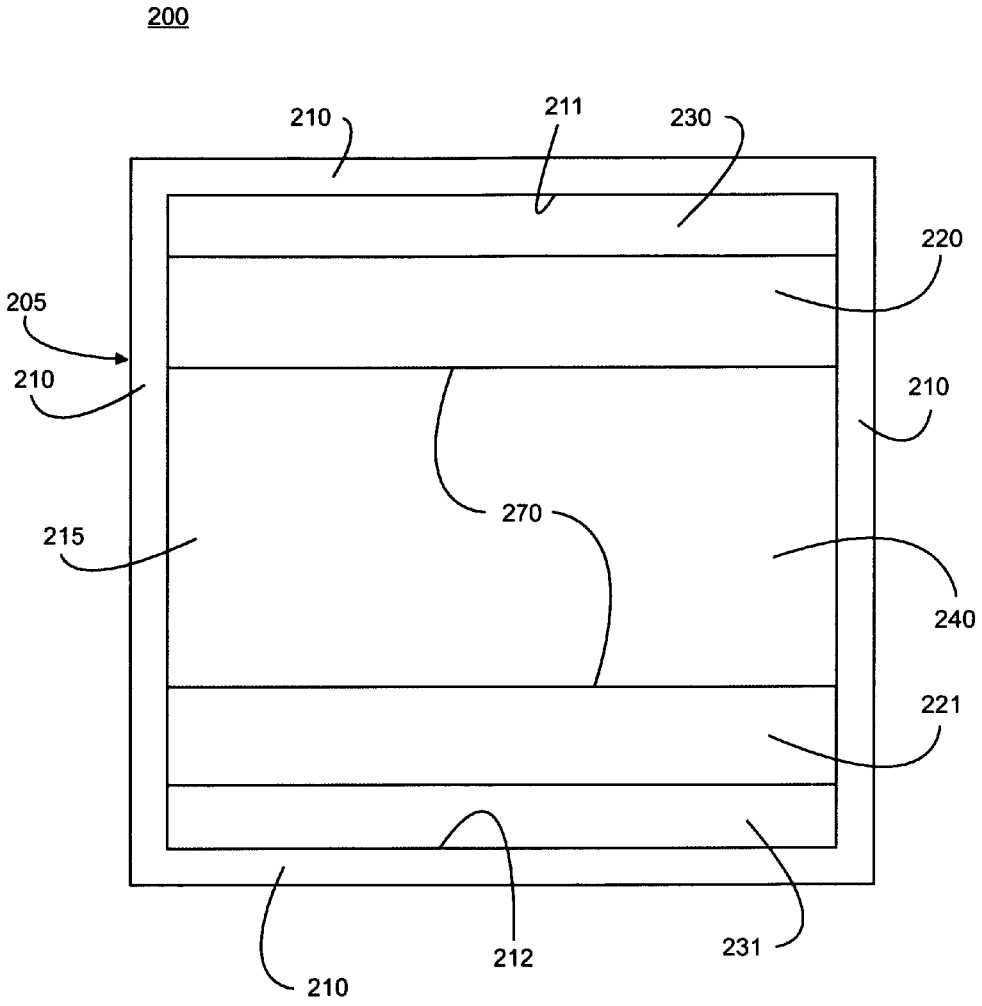
FIG. 2 is a schematic representation of another embodiment of the reaction container of the present invention.

Referring to FIG. 2, in one exemplary embodiment, the reaction container 200 includes two opposing portions of the water reactive material. The reactive container 200 includes a container 205 and a plurality of walls 210 defining the interior 215. The interior 215 includes a first end 211 and a second end 212 opposite the first end. A first portion of the water reactive material 220 is disposed adjacent the first end 211, and a second portion of the water reactive material 221 is disposed adjacent the second end 212. The volume of water 240 is disposed between the first and second portions of the water reactive material in the center of the interior of the container. The reaction container also includes a first detonation mechanism 230 in communication with the first portion of the water reactive material and located between the first portion of the water reactive material and the first end of the interior of the container. A second detonation mechanism 231 is provided in communication with the second portion of the water reactive material and is located between the second portion of the water reactive material and the second end of the interior of the container. Therefore, upon detonation, both the first and second portions of the water reactive material are driven into the center of the interior and mixed with the water.

Figure 3:
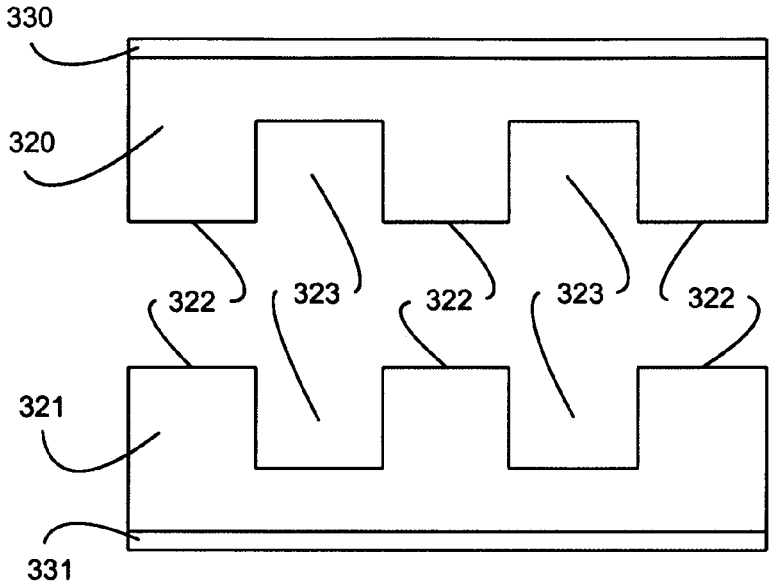
FIG. 3 is a schematic representation of an embodiment of an interface between the water reactive material and the water in the reaction container of the present invention.
Figure 4:
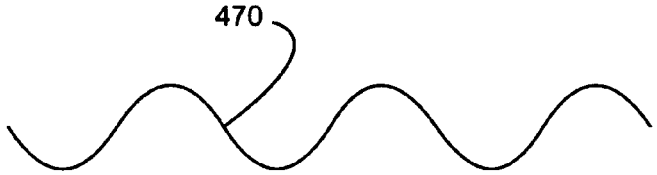
FIG. 4 is a schematic representation of another embodiment of an interface between the water reactive material and the water in the reaction container of the present invention.
Figure 5:
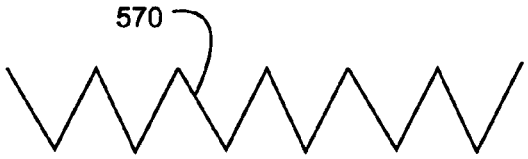
FIG. 5 is a schematic representation of another embodiment of an interface between the water reactive material and the water in the reaction container of the present invention.

As illustrated, the interface 270 between each portion of water reactive material and the water is a generally straight line or flat plane. However, the shape of this interface may be modified to increase the surface area of the water reactive material adjacent the water. Increasing this surface area increases the rate of mixing between the water reactive material and the water. As illustrated in FIG. 3, the first and second portions of the water reactive material 320, 321 may have a plurality of extensions 322 and a plurality of indentations 323. The total amount of water reactive material remains the same, but the length of the interface between the water reactive material and the water is increased. The first and second detonation mechanisms 330, 331 remain in the same relative positions to the first and second portions of the water reactive materials. In other embodiments, a curved interface 470 (FIG. 4) or a saw tooth interface 570 (FIG. 5) may be used between the water reactive materials and the water.

As an excessive amount of water may inhibit or quench the reaction with the water reactive material, the amount of water reactive material and the volume of water are balanced. In one embodiment, the amount of water reactive material is stoichiometrically balanced with the volume of water in the reaction container. Therefore, the volume of water equals just the amount of water required to oxidize, completely, the water reactive material. In one embodiment, the water reactive material includes aluminum, and the amount of aluminum in the water reactive material is stoichiometrically balanced with the volume of water in the reaction container.

When the detonation mechanisms are detonated, a shock wave is created that forces the portions of the water reactive material into the volume of water. When an arrangement of two opposing portions of the water reactive material is used, two detonation explosions cause opposing shock waves that propagate towards the center of the container and into the volume of water, mixing the water reactive material with the volume of water. When the opposing shock waves meet, a region of amplified pressure called a mach stem is created. The reaction between the water reactive material and the water often occurs in this mach stem region, for example towards the center of the container. The material and the water are mixed in this region and heated to a greater degree. This heating and mixing accelerates the reaction between the material and the water.

Exemplary embodiments in accordance with the present invention provide a stoichiometric balance between the amount of water reactive material and the volume of water in the container. Therefore, the volume of water and the amount of water reactive material are selected such that all of the water reactive material reacts with all of the water in the cavity. This balance prevents an excess amount of water that would be cool and slow the reaction.

It will be understood that many additional changes in details, materials, steps, and arrangements of parts which have been described herein and illustrated in order to explain the nature of the invention, may be made by those skilled in the art within the principle and scope of the invention as expressed in the appended claims. It will be understood that many additional changes in details, materials, steps, and arrangements of parts which have been described herein and illustrated in order to explain the nature of the invention, may be made by those skilled in the art within the principle and scope of the invention as expressed in the appended claims.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A reaction container, comprising:

an interior;

an amount of water reactive material being located within the interior, wherein the water reactive material comprises a plurality of separate and spaced apart portions, and wherein the water reactive material reacts violently with water to produce gas and heat;

a volume of water being disposed within the interior, being separated from the water reactive material and being arranged such that the water is located between any two portions of the water reactive material;

a detonation mechanism being configured for mixing the amount of water reactive material and the volume of water, and an interface being formed between each of said plurality of separate and spaced apart portion of the water reactive material and the water for increasing surface area and creating hotspots and localized high pressure regions, wherein the detonation mechanism is in communication with at least one of the plurality of portions of water reactive material, wherein the volume of water and the amount of water reactive material are stoichiometrically balanced, and wherein each of said plurality of separate and spaced apart portions of the water reactive material comprises a plurality of extensions and a plurality of indentations.

2. The reaction container of claim 1, wherein the interior comprises a first end and a second end opposite the first end, wherein the two portions of the water reactive material comprise a first portion disposed adjacent the first end of the interior and a second portion disposed adjacent the second end, and wherein the volume of water is disposed between the first portion and the second portion.

3. The reaction container of claim 1, wherein the interior comprises a first end and a second end opposite the first end, wherein the two portions of the water reactive material comprise a first portion disposed adjacent the first end of the interior and a second portion disposed adjacent the second end, wherein the volume of water is disposed between the first portion and the second portion, wherein the detonation mechanism comprises two identical detonation mechanisms, wherein the two identical detonation mechanisms comprise a first detonation mechanism and a second detonation mechanism, wherein the first detonation mechanism is disposed between the first portion and the first end, and wherein the second detonation mechanism is disposed between the second portion and the second end.

4. The reaction container of claim 1, wherein the water reactive material comprises at least one of a metal, a metalloid, a metal oxide, and a metalloid oxide.

5. The reaction container of claim 1, wherein the water reactive material comprises at least one of exploded aluminum, aluminum as a fine powder, and a plastic binder.

6. The reaction container of claim 1, wherein each portion of the water reactive material contains a plurality of distinct particles of the water reactive material, and wherein each of said plurality of distinct particles comprises a diameter of about 5 nanometers to about 3 micrometers.

7. The reaction container of claim 6, wherein the plurality of distinct particles of water reactive material comprise a plurality of distinct particles of aluminum.

8. A reaction container, comprising:

an interior;

an amount of water reactive material being located within the interior, wherein the water reactive material comprises a plurality of separate and spaced apart portions, and wherein the water reactive material comprises aluminum and reacts violently with water to produce gas and heat;

a volume of water being disposed within the interior, being separated from the water reactive material and being arranged such that the water is located between any two portions of the water reactive material;

a detonation mechanism being configured for mixing the amount of water reactive material and the volume of water, wherein the detonation mechanism is in communication with at least one of the plurality of portions of water reactive material, and wherein the volume of water and the aluminum in the water reactive material are stoichiometrically balanced; and an interface being formed between each of said plurality of separate and spaced apart portion of the water reactive material and the water for increasing surface area and creating hotspots and localized high pressure regions, wherein each of said plurality of separate and spaced apart portions of the water reactive material comprises a plurality of extensions and a plurality of indentations.

9. The reaction container of claim 8, wherein the water reactive material comprises about 85% aluminum.

10. The reaction container of claim 9, wherein the water reactive material further comprises about 15% of a plastic binder.

11. The reaction container of claim 8, wherein the water reactive material comprises two portions.

12. The reaction container of claim 11, wherein the interior comprises a first end and a second end opposite the first end, wherein the two portions of the water reactive material comprise a first portion disposed adjacent the first end of the interior and a second portion disposed adjacent the second end, and wherein the volume of water is disposed between the first portion and the second portion.

13. The reaction container of claim 11, wherein the interior comprises a first end and a second end opposite the first end, wherein the two portions of the water reactive material comprise a first portion disposed adjacent the first end of the interior and a second portion disposed adjacent the second end, wherein the volume of water is disposed between the first portion and the second portion, wherein the detonation mechanism comprises two identical detonation mechanisms, wherein the two identical detonation mechanism comprises a first detonation mechanism and a second detonation mechanism, wherein the first detonation mechanism is disposed between the first portion and the first end, and wherein the second detonation mechanism is disposed between the second portion and the second end.

14. The reaction container of claim 8, wherein the water reactive material further comprises at least one of exploded aluminum and aluminum as a fine powder.

15. The reaction container of claim 8, wherein each portion of the water reactive material contains a plurality of distinct particles comprised of aluminum, and wherein each particle of the plurality of distinct particles comprises a diameter of about 5 nanometers to about 3 micrometers.

16. The reaction container of claim 8, wherein the water reactive material further comprises one of magnesium, boron, titanium, tungsten and hafnium.

17. The reaction container of claim 8, wherein the water reactive material comprises at least one of aluminum oxide, titanium oxide, molybdenum oxide, vanadium oxide, and iron oxide.

18. The reaction container of claim 8, wherein the water reactive material comprises passivated aluminum.

* * * * *